US009512582B2

(12) United States Patent
Hill

(10) Patent No.: US 9,512,582 B2
(45) Date of Patent: Dec. 6, 2016

(54) EROSION CONTROL BLOCK

(71) Applicant: Michael Hill, Sugarland, TX (US)

(72) Inventor: Michael Hill, Sugarland, TX (US)

( * ) Notice: Subject to any disclaimer, the term of this patent is extended or adjusted under 35 U.S.C. 154(b) by 0 days.

(21) Appl. No.: 13/661,167

(22) Filed: Oct. 26, 2012

(65) Prior Publication Data

US 2014/0119831 A1 May 1, 2014

(51) Int. Cl.
*E02B 3/14* (2006.01)

(52) U.S. Cl.
CPC ..... *E02B 3/14* (2013.01)

(58) Field of Classification Search
USPC ..... 405/15–17, 284, 302.4, 302.6; 52/591.3, 52/592.2, 604, 606
See application file for complete search history.

(56) References Cited

U.S. PATENT DOCUMENTS

| | | | | | |
|---|---|---|---|---|---|
| 1,567,430 | A | * | 12/1925 | Eberling | 52/125.3 |
| 2,493,547 | A | * | 1/1950 | Paolella et al. | 52/605 |
| 2,519,664 | A | * | 8/1950 | Klein | 52/592.3 |
| 2,662,343 | A | * | 12/1953 | Rice | 47/33 |
| 2,876,628 | A | * | 3/1959 | Dixon, Jr. | 405/20 |
| 3,096,621 | A | * | 7/1963 | Danel | 405/16 |
| 4,227,829 | A | | 10/1980 | Landry, Jr. | |
| 4,370,075 | A | | 1/1983 | Scales | |
| 4,586,302 | A | * | 5/1986 | Kretschmar | E04G 25/00 52/173.1 |
| 4,781,492 | A | * | 11/1988 | Shindo | 405/16 |
| 5,020,938 | A | * | 6/1991 | Scales | 405/16 |
| 5,556,228 | A | | 9/1996 | Smith | |
| 5,647,169 | A | * | 7/1997 | Bui | 47/78 |
| 5,921,710 | A | | 7/1999 | Scales | |
| 5,988,942 | A | * | 11/1999 | Atkinson | 405/20 |
| 6,071,041 | A | * | 6/2000 | Knight | 405/16 |
| 6,079,902 | A | * | 6/2000 | Pettee, Jr. | 405/35 |
| 6,276,870 | B1 | | 8/2001 | Smith | |
| 6,558,074 | B2 | * | 5/2003 | Jansson | 405/16 |
| 6,955,500 | B1 | | 10/2005 | Smith et al. | |
| 8,123,435 | B1 | * | 2/2012 | DeShaw et al. | 405/16 |
| 2003/0147705 | A1 | | 8/2003 | McAllister et al. | |
| 2010/0104379 | A1 | | 4/2010 | Amuchastegui et al. | |

* cited by examiner

*Primary Examiner* — Kyle Armstrong
(74) *Attorney, Agent, or Firm* — Bushman Werner, P.C.

(57) ABSTRACT

A revetment block comprising a body having a first surface, a second surface and a plurality of peripherally extending side edges. The body has at least two arms extending laterally outwardly from the respective side edges and at least two sockets extending laterally inwardly from the respective side edges. There is at least one hole extending through the body, the hole having a first and a second portion. The first portion of the hole opens through the first surface of the block while the second opens through the second surface of the block. The first and second portions intersect interiorly of the block. The cross-sectional area of the first portion is less than the cross-sectional area of the second portion at the intersection of the first and second portions. Accordingly, the intersection of the first and second portions forms a ledge.

4 Claims, 3 Drawing Sheets

EROSION CONTROL BLOCK

BACKGROUND OF THE INVENTION

Field of the Invention

The present invention relates to erosion control and, more particularly, to an erosion control or revetment block which can be used to form an interlocking mat or material of similar blocks to prevent erosion due to water movement.

Description of the Prior Art

Erosion control blocks, so-called revetment blocks, are well known and have been used for years to prevent and or minimize erosion. In general, the revetment blocks are used to minimize erosion caused by the movement of water. The revetment blocks can be used along beaches, bays, lakeshores, waterways, channels, drainage ditches, and the like, so as to be able to revet, depending upon the particular environment, the effects of wave action, water runoff, channeled flow of water, etc.

Examples of revetment blocks can be found in U.S. Pat. Nos. 4,227,829, 4,370,075, 5,556,228, and 8,123,435, all of which are incorporated herein by reference for all purposes.

Revetment blocks currently used in erosion control generally comprise a body having a polygonal shape, e.g., square, which have at least two arms which extend from peripheral side edges of the body and at least one and preferably two sockets which extend into the body from peripheral side edges. It will be understood that depending upon the shape of the block, the number of arms and sockets and their relative position on the block can vary. For example, in one common revetment block which is square, there are two arms extending from respective sides of the block at 90° to one another and two sockets extending into the block from respective side edges, the sockets being disposed at 90° to one another.

It is also common for revetment blocks of the interlocking type as described above to include one or more holes extending through the block, i.e., from the first surface to the second surface. These holes serve the purpose of allowing vegetation to grow from below and through the block and help anchor the block to the surface exposed to the moving water.

SUMMARY OF THE INVENTION

In one aspect the present invention provides a revetment block which can interlock with similarly formed revetment blocks to form a mat or matrix resisting erosion caused by water movement over the mat.

In yet another aspect, the present invention provides a revetment block having a unique shaped hole(s) for vegetation growth.

These and further features and advantages of the present invention will become apparent from the following detailed description, wherein reference is made to the figures in the accompanying drawings.

DETAILED DESCRIPTION OF PREFERRED EMBODIMENTS

Figure 1:
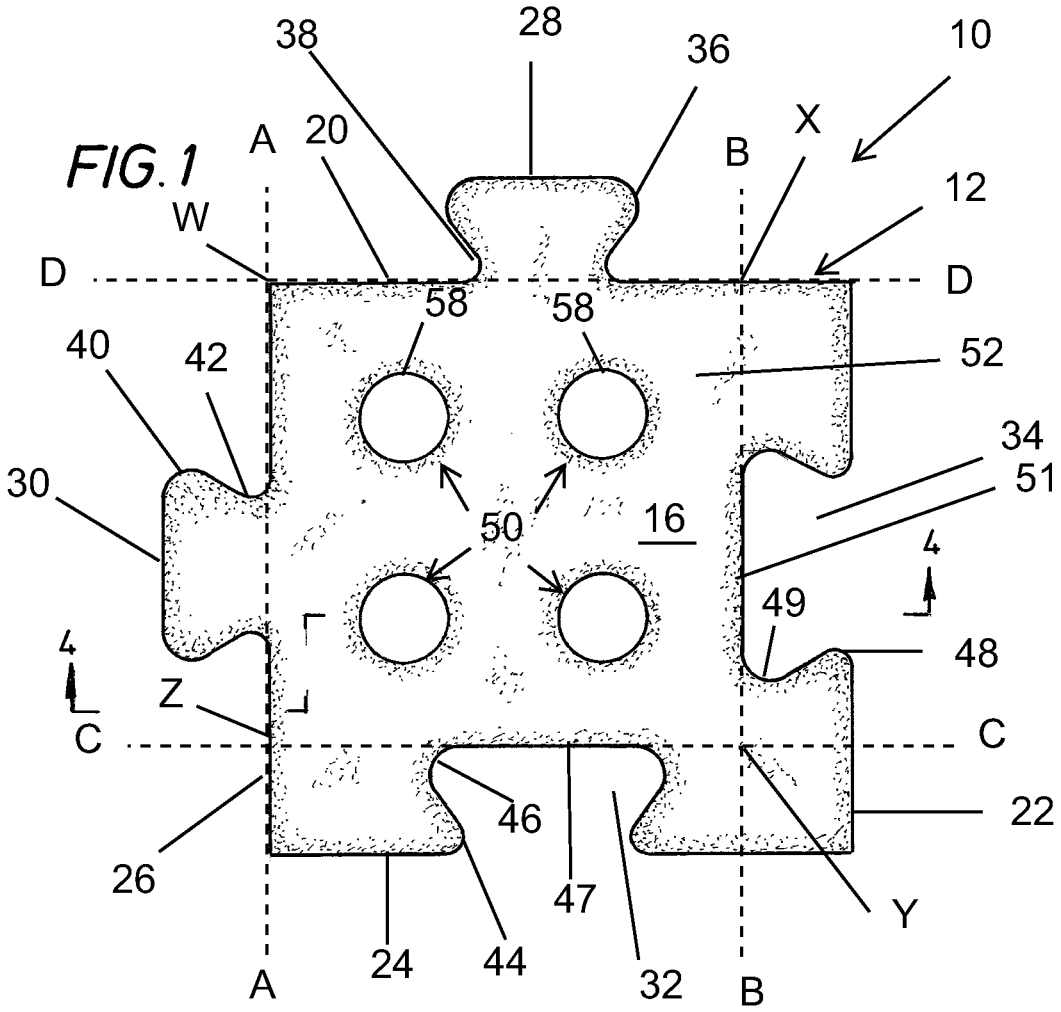
FIG. 1 is a top plan view of a revetment block according to one aspect of the present invention.
Figure 2:
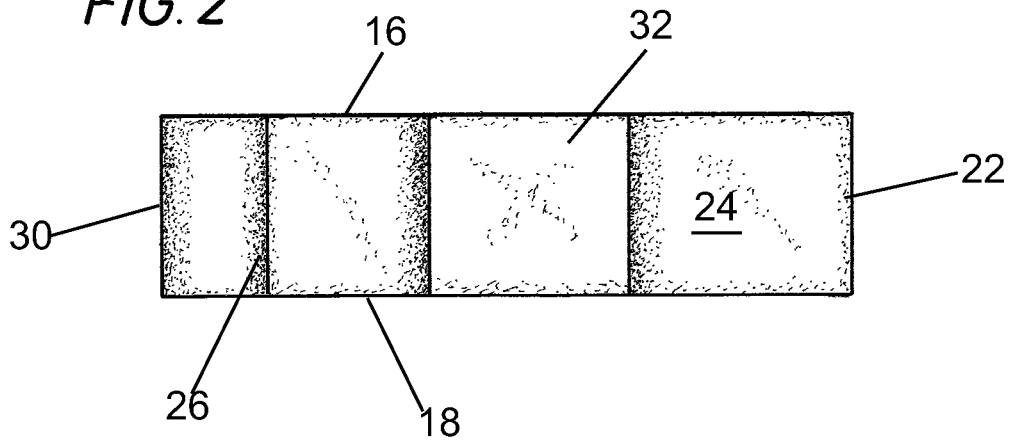
FIG. 2 is a side, elevational view of the revetment block shown in FIG. 1.
Figure 3:
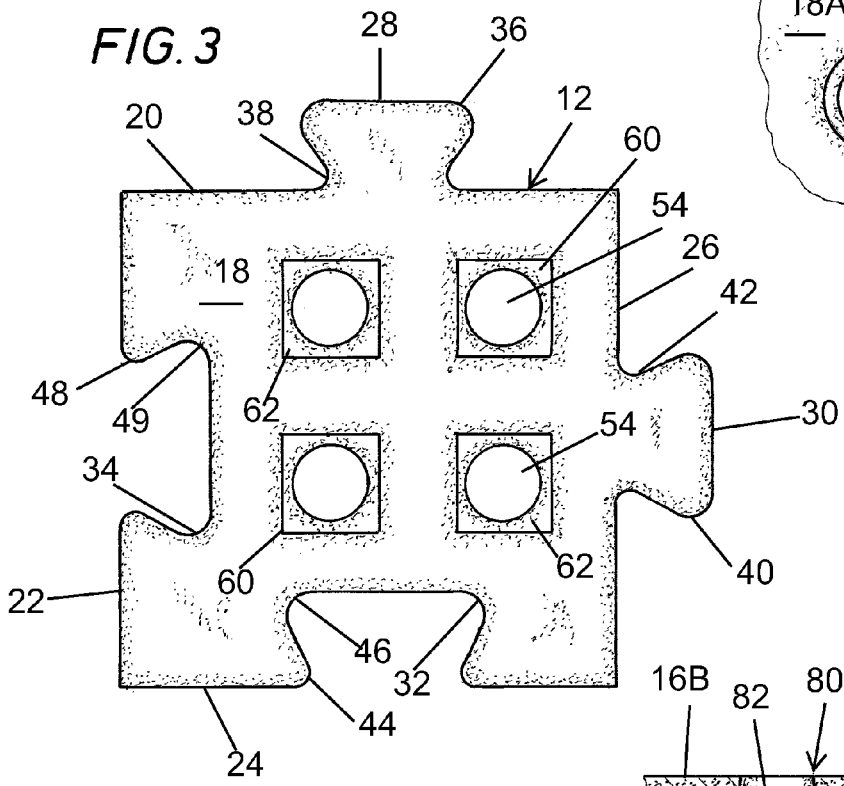
FIG. 3 is a bottom plan view of the block shown in FIG. 1.

Referring first to FIGS. 1-3, a revetment block, shown generally as 10, has a generally square body 12 having, a first, e.g., top surface 16, and an opposite, second, e.g., bottom surface 18. Body 12 has a first side edge 20, a second side edge 22, a third side edge 24, and fourth side edge 26. Extending from side edge 20 is an arm 28 while a second arm 30 extends, at 90° to arm 28, from side edge 26. A socket 32 extends into body 12 from side edge 24 while a second socket 34 extends, at 90° to socket 32, into body 12 from side edge 22. As can be seen from FIG. 1, arms 28 and 30 are generally complementary in shape to sockets 32 and 34 for reasons discussed hereafter. Arm 28 has an enlarged head portion 36 distal side edge 20, head portion 36 being connected to side edge 20 by a narrowed neck portion 38. In general, arm 28 has a generally dovetail shape when viewed in plan view. Similarly, arm 30, also having a dovetail shape, has an enlarged head portion 40 which is connected to side edge 26 via narrowed neck portion 42. Socket 32 has a mouth 44 which opens into an enlarged cavity 46, socket 32 being generally dovetail shaped when viewed in plan view. Likewise, socket 34 has a mouth 48 which opens into an enlarged cavity 49, socket 34 having a generally dovetail shape when viewed in plan view.

There are a plurality of holes, shown generally as 50 which extend through a core 52 of block 10. Core 52 is defined by four imaginary planes passing through lines indicated as A-A, B-B, C-C, and D-D with intersection points, W, X, Y, and Z wherein said planes are normal to said top and second surfaces 16 and 18, respectively. Thus, as can be seen, basically the core 52 is the portion of the block 10 which is defined by planes passing through the innermost walls 47 and 51 of the sockets 32 and 34, respectively, and planes passing through the intersection of the arms 28 and 30 with the side edges 20 and 26, respectively. As seen, holes 50 are generally symmetrically located within the core 52. However, it is to be understood that the holes need not be symmetrically positioned and can be arranged in various non-symmetrical orientations as desired. However, generally to ensure that the vegetation growth is uniform, symmetrical placement of holes 50 is normally desired. It will also be appreciated that fewer or more holes can be used if desired and their cross-sectional area can vary widely depending on the number of such holes.

Figure 4A:
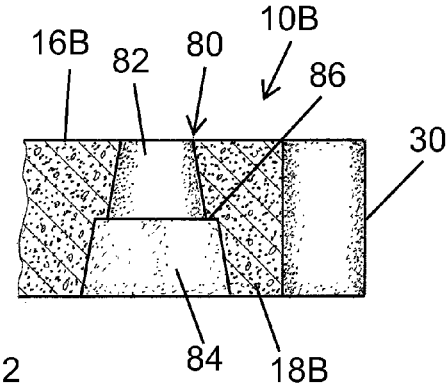
FIG. 4A is an elevational view similar to FIG. 4 showing another embodiment of the vegetation hole(s) used in the revetment block of the present invention.
Figure 4:
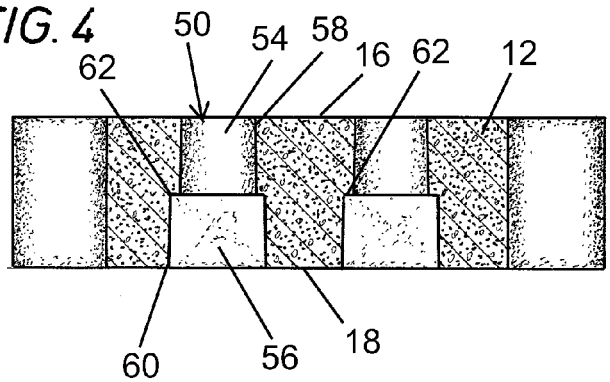
FIG. 4 is a view taken along the lines 4-4 of FIG. 1.

With reference to FIG. 4, it can be seen that holes 50 have a first portion 54 which opens through first surface 16 and a second portion 56 which opens through second surface 18. As can be best seen with reference to FIGS. 3 and 4, first portion 54 has a generally cylindrical cross-section forming a circular opening 58 and second portion 56 has a generally rectangular cross-section forming a square opening 60 through second surface 18 of block 10. As seen in FIG. 4, portions 54 and 56 intersect at a point generally midway through the thickness of block 10. However, it is to be understood that this intersection point is somewhat arbitrary, e.g., portion 54 could have a greater depth than portion 56 or vice versa.

At the intersection of portions 54 and 56, there is formed a ledge 62 which in the embodiment shown in FIG. 3, extends peripherally around portion 54. In any event, it will be recognized that where portions 54 and 56 intersect, second portion 56 will have a greater cross-sectional area than the cross-sectional area of first portion 54 at that intersection so as to form a ledge.

Figure 3A:
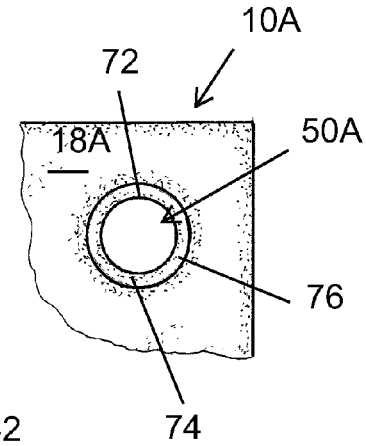
FIG. 3A is a partial, plan view of another embodiment of the vegetation hole(s) used in the revetment block of the present invention.

Referring now to FIG. 3A, there is shown a variation of a revetment block of the present invention. In all respects, the block 10A shown in the fragmentary view of FIG. 3A is like block 10 with the exception that the holes 50A of block 10A have first and second portions, both of which have circular cross-sections, the first portion opening into the first surface (not shown) defining a circular opening 72, the second portion opening into second surface 18A having a circular opening 74. However, again it will be seen that there is a ledge 76 formed at the intersection of the first and second portions of the holes 50A. Again, as shown in FIG. 3A, the ledge 76 extends peripherally around the first portion of hole 50A opening through the first surface of 10A.

Referring now to FIG. 4A, there is shown yet another embodiment of the revetment block of the present invention. The revetment block 10B, only a portion of which is shown in FIG. 4A has a first surface 16B, a second surface 18B and a hole 80 having a first portion 82 opening through first surface 16B, and a second portion 84 opening through second surface 18B. As can be seen from FIG. 4A, first portion 82 and second portion 84 have a frusto-shape in elevation wherein frusto-shape means a volume which can be circular or polygonal in cross-section and which varies in cross-sectional area along its length. A ledge 86 is formed at the intersection of the frusto-shaped portions 82 and 84, the ledge 86 surrounding frusto-shaped portion 82. It will thus be appreciated that both first and second portions 82 and 84, respectively could be frustoconical, the first portion could be frustoconical and second portion frustopyramidal, etc.

It will be apparent that any number of cross-sectional configurations of the holes can be employed, both for the first portion and the second portion, the requirement being that there be a ledge formed at the intersection of the first and second portions. It will also be understood that it is not necessary that the ledge extend in a peripheral fashion around the first portion, i.e., the portion opening through the first surface of the block. Rather, depending on the cross-sectional shape, the ledge could be formed by a series of discontinuous ledges. For example, if the first portion of the hole was circular in cross-section and the second portion of the hole was triangular, the ledge could be formed in three separate portions, it being understood that in such a configuration the triangle defined by the cross-section of the second portion would circumscribe the circle defined by the cross-section of the first portion. Thus, the cross-sectional shapes of the first and second portions can be circular, oval, octagonal, etc.

Figure 5:
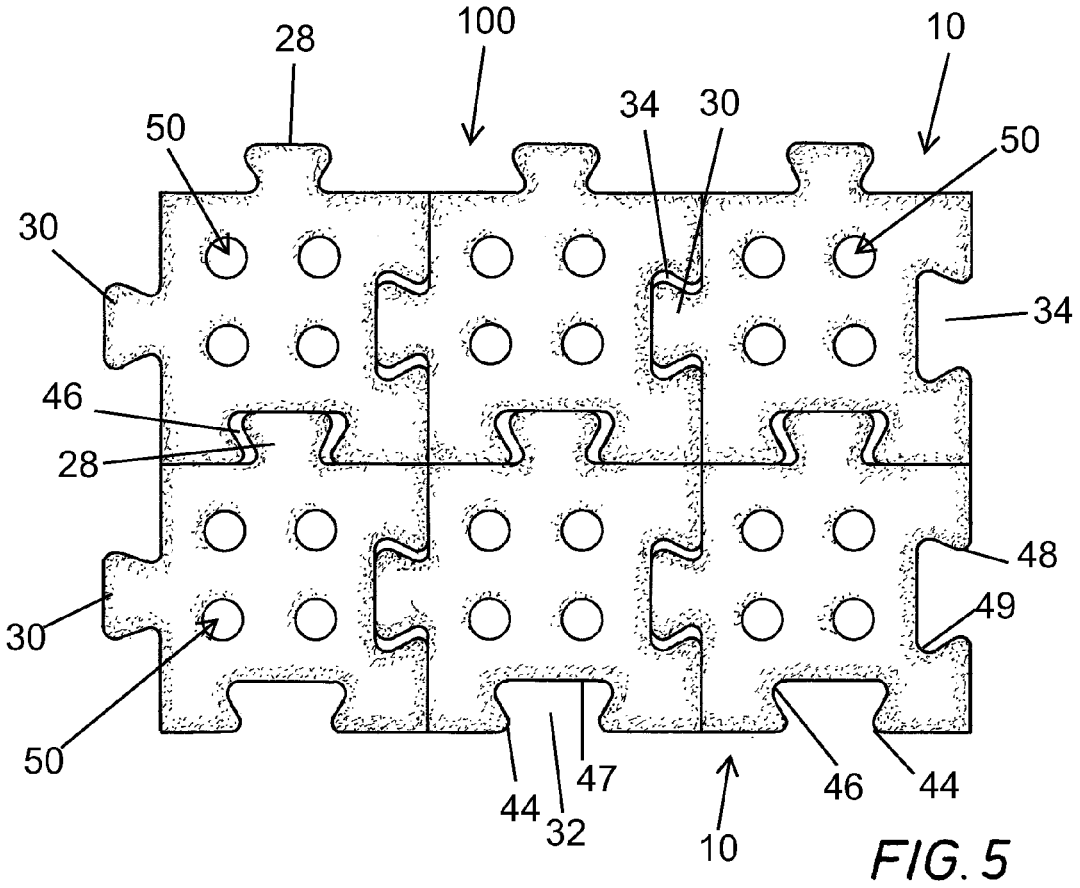
FIG. 5 is a top plan view of a mat made using the revetment blocks of the present invention.

Referring now to FIG. 5, there is shown a plan view of a mat formed by interlocked blocks 10. The mat shown generally as 100 depicts how the arm 30 of one block fits into the socket 34 of an adjacent block and the arm 28 of that same block fits into the socket 46 of an adjacent block. As can be seen, the sockets are slightly larger than the arms to permit some degree of freedom of movement laterally between adjacent blocks. Indeed, it can be seen that the blocks can be spread apart in two dimensions some distance to increase the area for vegetation growth. Although the arms fit loosely in the sockets, when moved apart laterally relative to one another, they do not separate because the heads, e.g. head 40 of arm 30 at its widest dimension is wider than the mouth, e.g. mouth 48 of socket 34.

Figure 6:
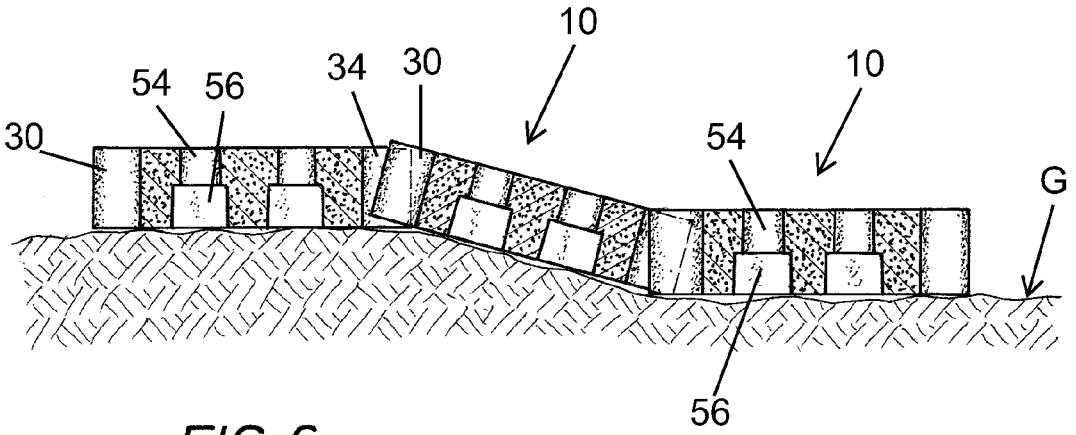
FIG. 6 is an elevational view, partly in section, of a mat made using the revetment blocks of the present invention depicting the ability of the blocks to adapt to uneven or undulating ground contours.

Referring now to FIG. 6, there is shown how the blocks can be vertically adjusted relative to one another to conform to a contoured or undulating ground surface shown generally as G. This ability of the blocks to articulate in a vertical direction relative to one another again is a function of the fact that the arms fit somewhat loosely in the sockets.

While not wanting to be bound by any theory, it is believed that the unique configuration of the vegetation holes through the block, e.g., holes 50, leads to enhanced vegetation retention of the block. In this regard, since, in one embodiment, the enlarged portion of the vegetation holes is adjacent the surface upon which the blocks are laid, vegetation growing up through the holes is believed to form a larger, more complex root structure in the enlarged area of the second portion of the holes, i.e., the portion that opens to the second surface of the blocks. Thus, it is believed the blocks can resist greater shear forces from moving water.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A revetment block, comprising:

a substantially square body having a first, substantially planar surface, an opposed second, substantially planar surface, a thickness defined by said first and second surfaces, and a plurality of peripheral side edges, said body including at least two arms extending laterally outwardly from respective said edges of said body and at least two sockets extending laterally inwardly from respective side edges of said body, said body having a core comprising the portion of the body bounded by four imaginary planes passing through said body from said first surface to said second surface and generally perpendicular thereto, wherein two of said planes pass through respective ones of said side edges and two of said planes pass through the radially innermost walls of respective ones of said sockets;

four symmetrically positioned holes extending through said core of said body, each of said holes comprising a first portion and second a portion, said first portion opening through said first surface of said block, said second portion opening through said second surface of said block, said first portion having a substantially circular cross-section, said second portion having a substantially square cross-section, said first and second portions intersecting in the interior of said body at a point substantially midway through said thickness, the cross-sectional area of said first portion being less than the cross-sectional area of said second portion at the intersection of said first and second portion, the intersection of said first and second portions forming an internal, peripherally extending ledge.

2. The revetment block of claim 1, wherein said arms and said sockets are complementary shaped.

3. The revetment block of claim 2, wherein each of said arms have an enlarged end connected to a respective side edge of said body by a narrowed neck portion and each of said sockets have an enlarged cavity formed in said block connected to a narrow inlet formed in said respective side edges of said body, each of said sockets being adapted for receiving therein an arm of a similarly constructed adjacent block.

4. The revetment block of claim 1, wherein said arms are at 90° to one another and said sockets are at 90° to another.

* * * * *